United States Patent [19]

Campagna

[11] Patent Number: 4,754,730

[45] Date of Patent: Jul. 5, 1988

[54] MOTOR VEHICLE STARTING SYSTEM

[76] Inventor: Marc Campagna, 19 Sherbrooke Street, Magog, Canada, J1X 1R3

[21] Appl. No.: 936,589

[22] Filed: Dec. 1, 1986

[51] Int. Cl.[4] ..... F02N 11/08

[52] U.S. Cl. ..... 123/179 B; 123/179 D

[58] Field of Search ..... 123/179 B, 179 D, 179 R, 123/179 BG; 290/50, 36 R, 38 R

[56] References Cited

U.S. PATENT DOCUMENTS

| | | | |
|---|---|---|---|
| 1,773,920 | 8/1930 | Mayforth . | |
| 2,152,405 | 3/1939 | Dreischerf | 290/37 |
| 2,729,750 | 1/1956 | Draper et al. | 290/36 R |
| 3,836,788 | 9/1974 | Carlson et al. | 290/50 |
| 4,412,137 | 10/1983 | Hansen et al. | 123/179 B |

FOREIGN PATENT DOCUMENTS

| | | | |
|---|---|---|---|
| 405094 | 6/1942 | Canada . | |
| 652332 | 11/1962 | Canada . | |
| 0116213 | 8/1984 | European Pat. Off. | 123/179 B |
| 301543 | 9/1954 | Switzerland | 123/179 B |

*Primary Examiner*—Andrew M. Dolinar

[57] ABSTRACT

The system includes an additional battery, a relay normally connecting a normal car battery and the additional battery in parallel for warm weather operation, said relay, when actuated, connecting the two batteries in series for cold weather operation to impart a boost to the motor vehicle starter. The switch controlling the relay is either a push-button switch mounted on the vehicle dash for manual operation, or a thermostatic switch controlled by the engine temperature. Preferably, the two batteries are located in a common casing.

3 Claims, 1 Drawing Sheet

MOTOR VEHICLE STARTING SYSTEM

FIELD OF THE INVENTION

The present invention relates to a motor vehicle starting system effective for cold weather as well as warm weather operation.

BACKGROUND OF THE INVENTION

In cold weather, say minus 10° C. and below, most motor vehicles fail to start when their starter is actuated. The vehicle-equipped battery fails because the lubricating oil is too viscous and because of the reduced power output of the battery. It is a conventional procedure to connect in parallel an additional battery to the vehicle battery to thus start the engine. Such a solution requires an extra battery, which has to be kept in a warm environment. It requires also opening the vehicle hood and to manually connect the two batteries with the risk of damaging the batteries when improperly connected.

OBJECTS OF THE INVENTION

It is the main object of the present invention to provide a motor vehicle starting system which can be used to effectively start the vehicle engine in cold as well as warm weather.

Another object of the present invention is to provide a system of the character described, wherein two batteries are provided which can be connected either in parallel for warm weather operation, or in series for cold weather operation.

Another object of the present invention is to provide a system of the character described, in which the two batteries are housed in a common casing, such that the system can be positioned within the available space under the hood of a vehicle.

Another object of the present invention is to provide a system which is automatically operated.

SUMMARY OF THE INVENTION

The starting system of the invention includes two batteries, a relay which, in a normal non-energized position, connects the two batteries in parallel to feed the engine starter and which, in an energized position, connects the two batteries in series to feed the engine starter at an increased voltage during the starting operation. A switch actuates this relay; this switch can be manually operated by the vehicle conductor when the engine fails to start when the batteries are parallel connected. Preferably, the switch is a thermostatic switch responsive to the temperature of the engine to actuate the relay below a present engine temperature.

BRIEF DESCRIPTION OF THE DRAWING

The single FIGURE is an electric diagram of the starting sytem of the invention.

DETAILED DESCRIPTION OF THE DRAWING

Figure 1:
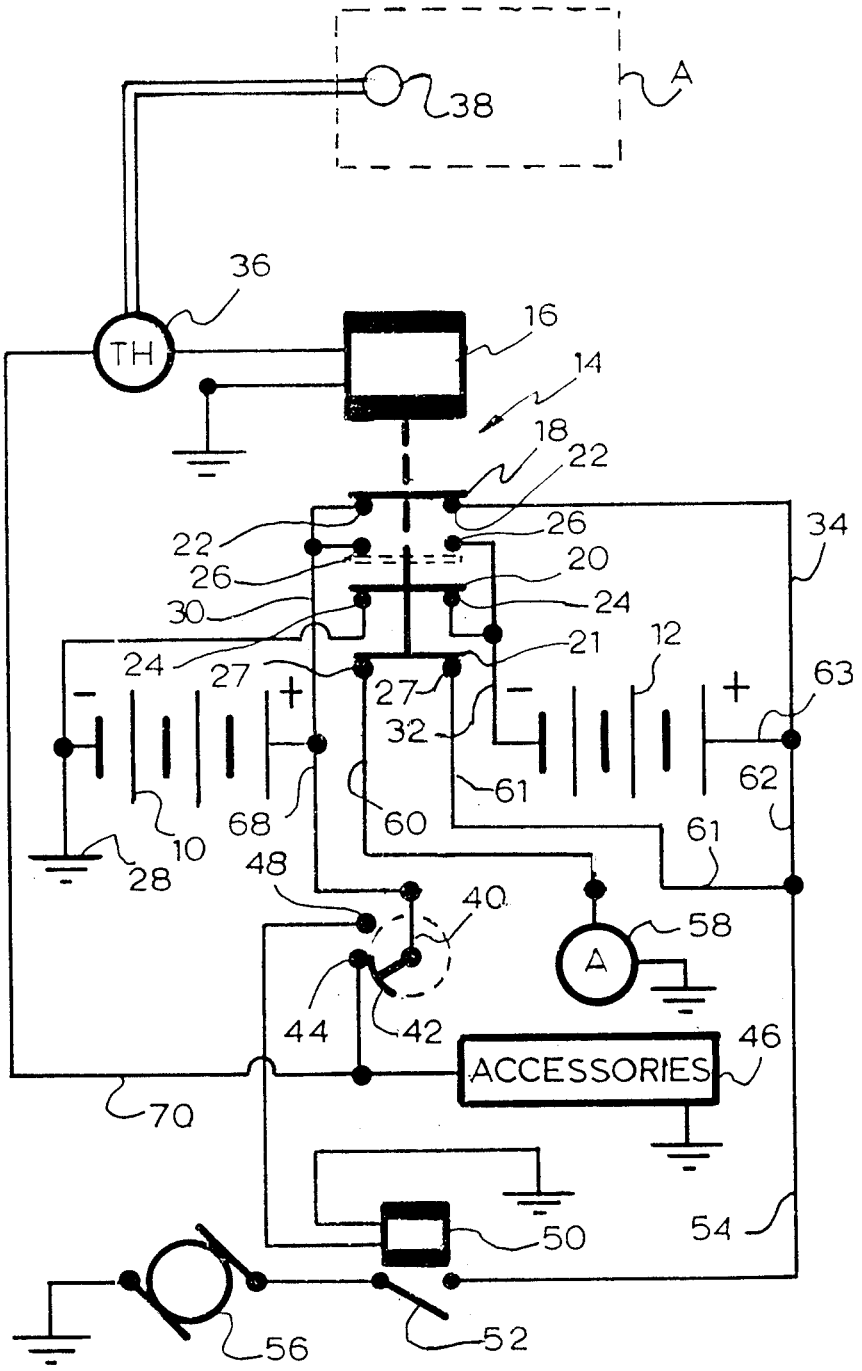

The circuit includes two wet-cell batteries 10 and 12, for instance each of 12-volt output but the second battery 12 could be of a lesser voltage. The system also includes a relay 14, which comprises an operating solenoid 16 for operating in unison first and second contact plates 18 and 20. First contact plate 18 is adapted to make contact and close the circuit between a pair of terminals 22, while second contact plate 20 is adapted to close the circuit between one or the other of the pairs of terminals 24 and 26. When solenoid 16 is not energized, contact plate 18 closes the circuit between terminals 22 and contact plate 20 closes the circuit between terminals 24 When the solenoid 16 is energized, the circuit between terminals 22 is open and the circuit between lower terminals 24 is open, while the circuit between the upper terminals 26 is closed. Contact plate 18, with its terminals 22, form a single pole single throw-switch, while contact plate 22 and its associated terminals 24, 26 form a single pole double-throw switch. The negative of the first battery is connected to the ground at 28, while its positive terminal is connected by wire 30 to the terminals 22 and 26 on one side of relay 14. The negative of the second battery 12 is connected by wire 32 to terminals 24 and 26 on the other side of relay 14. The positive of battery 12 is connected by wire 34 to the other terminal 22 of relay 14. The solenoid 16 is controlled by a switch 36. This switch can be a manually-operated push-button switch mounted on the dashboard of the motor vehicle. Preferably, as shown in the drawing, it is a thermostatic switch which is responsive to the temperature of the manifold A of the vehicle engine. For instance, a thermocouple 38, applied to said manifold, senses the temperature thereof. This thermocouple closes the thermostatic switch 36 when the temperature of the manifold is, for instance, below minus 10° C.

Relay 14 preferably further includes a third contact plate 21 adapted to interconnect a pair of terminals 27 when the solenoid 16 is not energized. Elements 21, 27 define an additional single pole, single-throw switch.

The conventional key-operated control switch 40 of the vehicle includes a contact arm 42, which, in a running position, only contacts terminal 44 to feed the accessories 46, and in the other position makes contact not only with terminal 44 but also with terminal 48 of the solenoid 50 of the starter relay contact arm 52, which closes the circuit from the batteries through wire 54 to the starter motor 56. The vehicle is also normally provided with an alternator or generator, indicated at 58, to recharge the batteries 10,12 in parallel through wires 60,61, relay switch portion 27, 21, wires 61, 62, 63 and through wire 34, contacts 22 and wire 30. Switch 40 is connected to battery 10 through wire 68. The accessories terminal 44 is also connected through wire 70 to the switch 36 and relay 16.

The system operates as follows: Whenever the engine is warm enough to start without difficulty, the relay 14 is in the normal position, shown in full line in the drawing, whereby the batteries 10, 12 are connected in parallel. The ignition switch is fed in parallel by the two batteries and the alternator can recharge the two batteries in parallel through the relay switch portions 21, 27, and 22, 18. Whenever the engine fails to start due to the engine being exposed to too low a temperature, the thermostatic switch 36 automatically closes and, upon operating the key-operated switch 40 to the starting position, the circuit comprising terminal 44, wire 70, closed switch 36 and relay solenoid 16 is closed, whereby the two batteries 10 and 12 are connected in series to feed the starter 56. However, the accessories 46 are fed by only a 12-volt current from the to battery 10. Thus, damage to the accessories 46 is prevented. The accessories comprise the ignition system, the lighting system of the vehicle, together with any other electric circuits functioning normally at 12 volts. It is understood that the alternator is provided with its associated voltage regulator. This alternator is protected because relay switch portion 21, 27 opens when the two batteries are series connected.

In cold weather, the voltage of each battery is much decreased, so that series-connecting the same will not apply excessive voltage to the starter 56. Thermostatic switch 36 is preferred, because it ensures that battery series connecting is effected only in cold weather. It also has the advantage of automatic operation.

The two batteries 10, 12 more specifically the two groups of cells, each forming one battery, can be arranged in one battery casing of the same size as a conventional battery, by reducing the number of plates or thickness thereof, so that the whole system can be located within the available space of any motor vehicle. Obviously, the two batteries can be separate units. The relay 14 can be mounted directly on top of the battery casing.

What I claim is:

1. In a motor vehicle haivng a first wet-cell battery, a motor-operated recharging generator, a motor starter, a starter relay, an ignition system, and a key-operated switch having a starting position for operating the starter relay and the ignition system, and a running position for operating the ignition system exclusive of the starter relay, and first circuit means connecting said starter relay, ignition system and key-operated switch to said first battery, a cold weather starting system including a second wet-cell battery, second circuit means connecting said first and second batteries in parallel to said generator, and third circuit means for connecting said first and second batteries to said motor starter through said starter relay, either in series for cold weather starting or in parallel for warm weather starting, said third circuit means including a switching relay which, in normal non-energized position, connects the first and second batteries in parallel, and which in an energized position, connects said first and second batteries in series, and a switch to energize said switching relay, series connected between the solenoid of said switching relay and said ignition system and being an automatic switch responsive to the ambient temperature and taking an open and a closed position above and below a predetermined ambient temperature.

2. In a motor vehicle as defined in claim 1, wherein said last-named switch is a thermostatic switch with a temperature responsive sensor exposed to the temperature existing in the manifold of the engine of said motor vehicle.

3. In a motor vehicle as defined in claim 2, wherein said switching relay includes a switching element connected between said generator and the positive side of said batteries and opening the circuit between said generator and said batteries when said switching relay is in its energized position.

* * * * *